US006588621B2

(12) United States Patent
Shimazaki

(10) Patent No.: US 6,588,621 B2
(45) Date of Patent: Jul. 8, 2003

(54) BEVERAGE BOTTLE COOLING METHOD AND APPARATUS WITH ASSEMBLY FOR HOLDING ICE AND WATER

(76) Inventor: J. John Shimazaki, 47799 MacGill Ct., Sterling, VA (US) 20165

( * ) Notice: Subject to any disclaimer, the term of this patent is extended or adjusted under 35 U.S.C. 154(b) by 0 days.

(21) Appl. No.: 10/066,656

(22) Filed: Feb. 6, 2002

(65) Prior Publication Data

US 2003/0075548 A1 Apr. 24, 2003

Related U.S. Application Data

(63) Continuation-in-part of application No. 09/983,107, filed on Oct. 23, 2001, now abandoned.

(60) Provisional application No. 60/246,493, filed on Nov. 6, 2000.

(51) Int. Cl.[7] ..... B65D 23/02

(52) U.S. Cl. ..... 220/592.17; 220/23.89; 220/737; 220/739

(58) Field of Search ..... 220/592.17, 592.18, 220/592.28, 23.89, 23.87, 737, 739; 248/311.2

(56) References Cited

U.S. PATENT DOCUMENTS

| | | | |
|---|---|---|---|
| 81,814 | A | 9/1868 | Nuellens et al. |
| 303,815 | A | 8/1884 | Cramer |
| 379,823 | A | 3/1888 | Shaw |
| 592,781 | A | 11/1897 | Hertwig |
| 1,009,406 | A | 11/1911 | Graham |
| 1,218,827 | A | 3/1917 | Baer |
| 1,280,501 | A | 10/1918 | Lewis |
| 1,519,034 | A | 12/1924 | Livingston |
| 1,657,927 | A | 1/1928 | Heizen |
| 2,032,130 | A | 2/1936 | Jurkat et al. |
| 2,622,415 | A | 12/1952 | Landers et al. |
| 2,838,916 | A | 6/1958 | Sola |
| 2,868,411 | A | 1/1959 | Kesselman |
| 2,926,508 | A | 3/1960 | Moon |
| 3,302,427 | A | 2/1967 | Stoner et al. |
| 3,765,559 | A | 10/1973 | Sauey et al. |
| 3,995,445 | A | 12/1976 | Huskins |
| 3,998,072 | A | 12/1976 | Shaw |
| 4,281,520 | A | 8/1981 | Norwood |
| 4,338,795 | A | 7/1982 | House, Jr. |
| 4,638,645 | A | 1/1987 | Simila |
| 4,798,063 | A | 1/1989 | Rimmer |
| 5,090,213 | A | 2/1992 | Glassman |
| 5,177,981 | A | 1/1993 | Haas |
| 5,243,835 | A | 9/1993 | Padamsee |
| 5,390,804 | A | 2/1995 | Beggins |
| 5,406,808 | A | 4/1995 | Babb et al. |
| 5,555,746 | A | 9/1996 | Thompson |
| 5,573,141 | A | 11/1996 | Chen |
| 5,904,267 | A | 5/1999 | Thompson |
| 5,967,378 | A | 10/1999 | Arispe |
| 6,085,543 | A | 7/2000 | Su |
| 6,240,741 | B1 | 6/2001 | Dozhier |
| 6,276,163 | B1 | 8/2001 | Broadbent |

*Primary Examiner*—Joseph M. Moy

(57) ABSTRACT

The present invention relates to a beverage bottle cooling method and apparatus comprising a container for containing ice and/or water that is adapted to have a commercial beverage bottle positioned substantially therein, wherein regular ice and/or water can be stored and sealed within the space between the bottle and container, to help keep the beverage inside cool. The space is preferably substantially sealed by a cap which is adapted with an opening and sealing ring that extends over the neck of the bottle, wherein the bottle can be held in substantial compression between the sealing ring and one or more supports extending substantially underneath the bottle. The supports preferably provide vertical and lateral support to the bottle, and substantially prevent the bottle in the cooling device from rotating, which enables the bottle lid to be easily opened and closed. The container is also preferably adapted in relation to the bottle in a way that enables the bottle to be held in an elevated position, so as to maximize contact with ice, and ice to be easily displaced when the bottle is inserted into the container.

25 Claims, 4 Drawing Sheets

BEVERAGE BOTTLE COOLING METHOD AND APPARATUS WITH ASSEMBLY FOR HOLDING ICE AND WATER

RELATED APPLICATIONS

This application is a continuation-in-part of U.S. patent application Ser. No. 09/983,107, filed on Oct. 23, 2001, now abandoned, which is incorporated herein by reference in its entirety, and which claims priority from U.S. Provisional Application Serial No. 60/246,493, filed on Nov. 6, 2000.

FIELD OF THE INVENTION

The present invention relates to the field of beverage coolers, and in particular, to a beverage cooling method and apparatus with an assembly for holding ice and water.

BACKGROUND OF THE INVENTION

Commercial beverages, such as soda, juice, fruit drinks, sports drinks, water, etc., are often sold in bottles made of PET. A typical beverage aisle of a grocery store or refrigerator of a convenience store is full of a wide variety of bottled beverage products in all shapes and sizes. While most aluminum cans are sold in 12 ounce sizes, most PET bottles are sold in larger sizes, ranging from ½ liter to 3 liters, including the popular 20 ounce, 64 ounce and 2 liter PET sizes.

The development of larger PET bottle sizes has meant that the consumer receives more beverage per container. But the downside is that with more beverage, additional cooling is needed to keep the beverage in the bottle cool, i.e., for a longer period of time. For example, when a single serving 20 ounce bottle is purchased, more beverage means that it will take more time to finish the beverage, or that beverage will be left over. In either case, when the weather is warm, such as on a hot sunny day, or inside a hot car, exposure to high temperatures can result in the beverage becoming warm quickly without any means of keeping the beverage cold. Two liter and other larger sizes are susceptible to the same circumstances, such as during an outdoor picnic, or other function, where no refrigerator is available to keep the beverage cold.

In the past, resort has been made to using ice chests, but there are disadvantages to doing so. For example, because PET bottles are often larger than cans, larger ice chests are typically needed, in which case they can be quite cumbersome to use. Moreover, it is particularly burdensome to use an ice chest if only a single serving beverage is desired. Also, when two liter or other larger bottles are involved, it is often impractical to keep them in ice chests while the beverage is being served.

Many individuals choose to pour beverages into other containers, such as cups, mugs, sports bottles, thermal bottles, etc., with ice directly in the beverage to keep it cold. The disadvantage of this, however, is that as ice melts, the beverage becomes diluted. Also, because ice is often made with unfiltered tap water, impurities can be introduced into the beverage, which can, for instance, defeat the purpose of buying bottled water. Carbonation can also dissipate quickly as beverage is poured into another container. The containers also have to be washed after each use.

Archaic attempts have also been made, such as in the days when refrigerators were not available. For example, in U.S. Pat. Nos. 81,814 and 303,815, wine bottle coolers with diaphragms and springs to hold bottles in place are shown, but these designs are neither compact, nor suitable for bottles with twist off lids, since the bottles were free to rotate. In later years, as shown in U.S. Pat. Nos. 3,998,072, 4,281,520, 5,555,746 and 5,904,267, containers with various compartments, sleeves and packs filled with refrigerants that could be frozen were also developed, but these were required to be frozen and refrozen after each use, and therefore, were not widely used. Various types of insulated containers were also developed, which helped to maintain the temperature of the beverage, with no ability to make the beverage any colder.

What is needed, therefore, is a new and improved method and apparatus for keeping beverages cold, which overcomes the disadvantages of previous cooling methods and apparatuses.

SUMMARY OF THE INVENTION

The present invention relates to a method and apparatus for cooling beverage bottles and/or keeping beverage bottles cold. The present invention generally comprises a cooling device for containing ice and/or water adapted to have the beverage bottle positioned therein, wherein regular ice, such as from a conventional dispenser, and/or water, can be stored and sealed within the space between the container and bottle, to keep the beverage cool.

The container is preferably specifically sized and shaped so that a particular beverage bottle can be held securely inside, wherein a cap is provided to create a water-tight seal around the shoulder of the bottle, and one or more supports are provided under the bottle to provide lateral and vertical support thereto. In this respect, the bottle is preferably held in substantial compression inside the container, with the neck of the bottle extending through the cap, with the seal substantially preventing ice and/or water from leaking out. This way, ice and/or water can be maintained in direct contact with the bottle, and the beverage can be maintained at a reduced temperature, without diluting or introducing contaminants into the beverage. The beverage can also easily be poured, served and consumed without having to take the bottle out of the ice.

In the preferred embodiment, the container is preferably adapted to securely hold a particular beverage bottle, such as a PET bottle having a certain size and shape. In this embodiment, the container is preferably comprised of two sections that can be connected and sealed together, i.e., an upper cap member and a lower container member. The container member is preferably an open-top container, similar to a mug, with a handle, or grips thereon, adapted so the bottle can be inserted at least partially into the container and supported thereby. The cap member is preferably a cap-like member that can be secured and sealed onto the container member. Unlike previous caps, however, this member preferably has a central opening, with a sealing ring positioned substantially along the inside surface thereof around the opening. This way, when the beverage bottle is placed inside the container, the neck can be extended through the opening, wherein the cap member can be tightened onto the container, such that the sealing ring is pressed and sealed against the exterior of the bottle, i.e., around the shoulder of the bottle, thereby sealing the space between the bottle and container.

The container member preferably has one or more individual supports on the inside thereof to provide vertical and lateral support to the bottle. This way, when the cap member is tightened onto the container member, the bottle can be held in substantial compression between the sealing ring and supports. In one embodiment, three or more supports are extended inside the container member to provide a support system for self-centering the bottle and maintaining the bottle above the floor of the container member. Each support in such case is preferably adapted to engage a lower portion of the bottle such that the bottle can be held in a substantially fixed position. In another embodiment, a single pedestal can be provided which extends upward from the floor of the container member to engage the center indentation on the bottle. In either case, the support system preferably keeps the bottle elevated above the floor of the container member, although not necessarily so, to allow ice and/or water to be distributed below the bottle. A goal of the present invention is to substantially minimize the surface area contact between the container and bottle, on one hand, and substantially maximize the surface area contact between the ice and/or water and bottle, on the other hand.

Another aspect of the present invention is that at least one of the supports is preferably adapted to mate with a portion of the bottle to substantially prevent the bottle from rotating, which enables the lid on the beverage bottle to be easily opened and closed without the bottle rotating inside. Preventing rotation of the bottle can be accomplished by adapting at least one of the supports to mate with or engage a groove or indentation on the bottom exterior of the bottle. Where PET bottles having multiple grooves or other formations are used, at least one support is preferably adapted to fit into one of the grooves, wherein with the bottle in compression, the bottle can be prevented from rotating.

In the pedestal embodiment, the upper surface of the pedestal can be configured to conform or otherwise mate with or engage the bottom of the bottle, wherein the mating of the two surfaces, with the bottle in compression, can prevent the bottle from rotating. This can be done, for example, by adapting the upper surface of the pedestal to fit into the indentation located on the bottom of the bottle. Alternatively, the pedestal can be removable or made with a coil spring to enable bottles of different shapes and sizes to be used.

The cap and container members are preferably connected together with threads, with an overlapping interference fit, or a gasket, so that they can easily be sealed together. The cap and container members are preferably adapted so that the connection between them can be sealed at the same time that the cap is sealed against the bottle. That is, the container is preferably adapted so that the connection between the cap and container, and between the cap and bottle, occur at the same time, i.e., with the cap in the same position relative to the container.

The present invention contemplates that a lower portion of the container can be made relatively narrow, so that it can fit in conventional cup holders, such as found in cars. This portion creates additional space in which ice and/or water can be stored, such as underneath the bottle, in direct contact with the bottle. It is preferable that the supports be extended from the wall of the container, such as on or just above the narrowed portion, so that the bottle can be elevated above the floor of the container. The area of the container just above the narrowed portion can be extended radially outward, such as along a curved and/or angled surface, to enable ice to climb up the walls as the bottle is shoved into the container.

The sealing ring is preferably secured to the inside of the cap and extended around the opening so that it can be pressed against the bottle, and made of a resilient and firm material that can apply pressure against the bottle to create a waterproof seal. Although the sealing ring can be secured to the cap by any conventional means, such as adhesives, for ease of assembly, the sealing ring preferably has a flange that can extend through the opening, wherein the ring can be snapped into the cap from underneath.

Another aspect of the present invention is that the cooling device can be specifically made to accommodate a certain type of beverage container, while not accommodating other beverage containers, such as those having different sizes and shapes. PET bottles often come in a variety of different sizes and shapes, even when the same amount of beverage is contained. For example, Coke® currently uses 20 ounce bottles that have a tapered neck, whereas Pepsi® uses 20 ounce bottles that are bubble-like with swirls. A unique aspect of the present invention is that the cooling device can be made so that it allows one type of bottle to be used, i.e., a Pepsi® 20 ounce bottle, whereas other bottles, such as one made by a competitor, i.e., a Coke® 20 ounce bottle, would either not fit, or allow water to leak.

This can be done, for example, by adapting the cooling device so that the distance between the sealing ring and supports, when the cap is tightened onto the container, only allows one bottle to fit properly. Accordingly, by promoting the cooling device, and getting people to try it, one manufacturer can potentially increase sales and market share of its own bottled products because consumers will have to buy them to use the cooling device. Buying any other bottled product made by any other manufacturer would make it so that the cooling device cannot be used.

DESCRIPTION OF THE INVENTION

Figure 1:
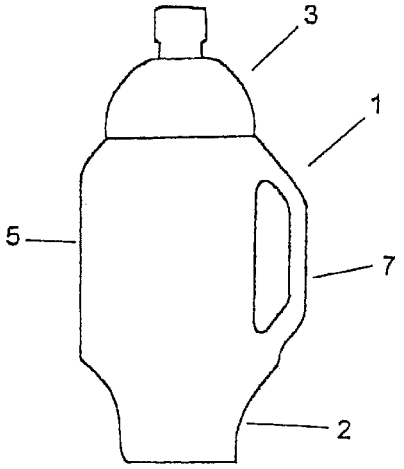
FIG. 1 is a side view of an embodiment of the present invention.
Figure 2:
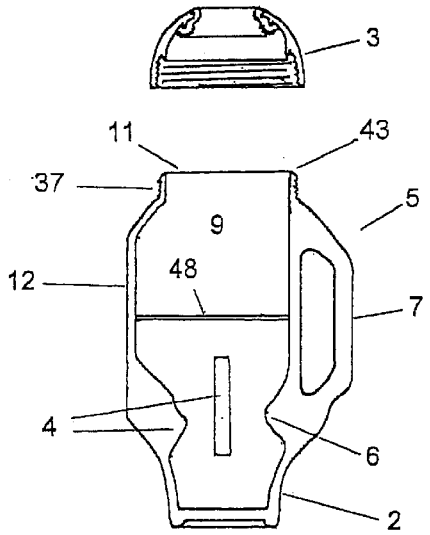
FIG. 2 is a section view of the embodiment of FIG. 1.
Figure 3:
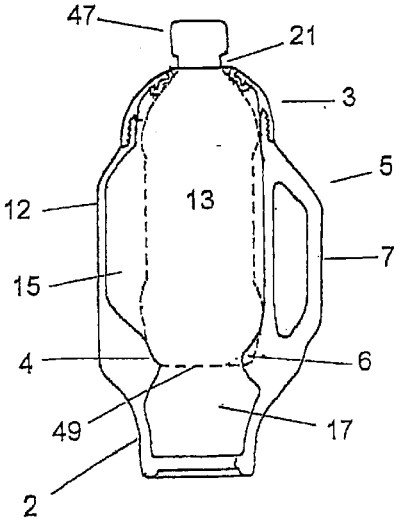
FIG. 3 is another section view showing a PET bottle in dashed lines.

FIGS. 1–3 show an embodiment of the present invention 1 having a container 5 and cap 3 designed to be connected and sealed together. As seen in FIGS. 2–3, container 5 is preferably an open-top container having a handle 7 and an internal space 9 formed by a wall 12, wherein an opening on the top 11 preferably enables a bottle 13, such as a commercial PET bottle, to be inserted therein. Container 5 preferably has extended on the inside thereof a plurality of supports 4, 6, such as from wall 12, which are adapted to provide lateral and vertical support to bottle 13. This way, bottle 13 can be inserted into container 5 and held by supports 4, 6, wherein cavities or spaces 15, 17 can be formed between bottle 13 and container 5, in which ice and/or water can be stored and sealed.

Wall 12 can be round or any shape that allows space 15 of sufficient size to be formed. Preferably, the distance between wall 12 and bottle 13 allows conventional size ice particles, such as from conventional ice dispensers, to be easily distributed and stored therein. Most ice particles from ice dispensers are less than about one inch thick, and therefore, it is contemplated that the distance between bottle 13 and wall 12, as shown in FIG. 3, can be about one inch, although virtually any dimension that serve the intended purpose can be used. While it is desirable to provide sufficient space 15 for the ice, it is also desirable for container 5 to be compact, and therefore, the present invention contemplates that these factors should be taken into consideration when forming container 5 based on bottle 13.

Figure 9:
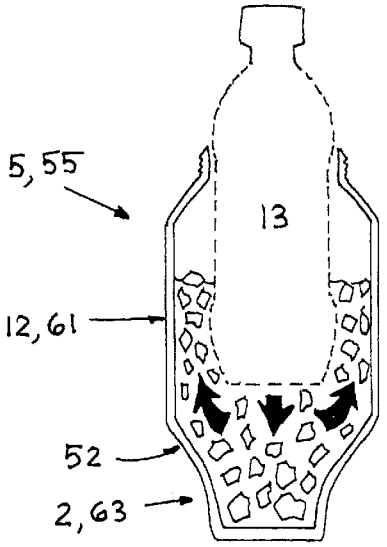
FIG. 9 shows ice being displaced by the bottle inside the container.
Figure 10:
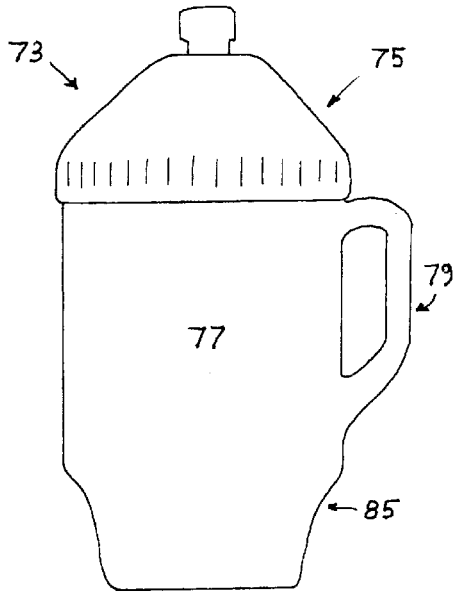
FIG. 10 shows another embodiment of the present invention.

Container 5 preferably gas a lower section 2 that is narrowed, such as below supports 4, 6, to fit into conventional cup-holders. Lower section 2 preferably forms cavity 17 below bottle 13 and allows additional ice to be stored in container 5 substantially surrounding a lower end 49 of bottle 13, as shown in FIG. 3. The section 52 immediately above lower section 2, in such case, is preferably extended radially outward, such as in a curved and/or angled manner, wherein this configuration 51 can cause ice to climb up the sidewall of bottle 13 when bottle 13 is shoved into the ice, as shown in FIG. 9. The location of sloped surface 51 in relation to supports 4, 6 and bottle 13 preferably ensures that ice can easily be displaced around bottle 13 without getting caught inside lower section 2. In this embodinebt, tope 11 of container 5 can be narrowed to receive a relatively narrow cap 3.

Figure 5:
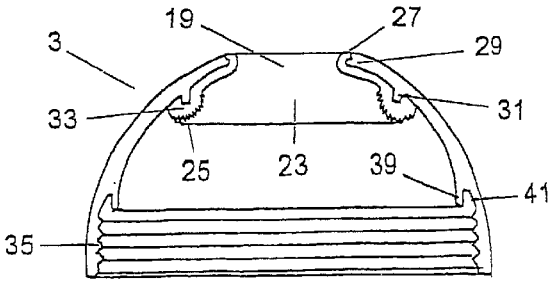
FIG. 5 is a section view of the cap.

Cap 3 preferably has a central opening 19, as shown in FIG. 5, through which neck 21 of bottle 13 can extend. Cap 3 also preferably has one or more resilient sealing members, such as a sealing ring 23, extended on the inside and substantially around opening 19. When cap 3 is connected to container 5, with neck 21 extended through opening 19, ring 23 is preferably adapted so that it engages and presses against the shoulder of bottle 13, to substantially seal bottle 13 inside container 5.

Figure 11:
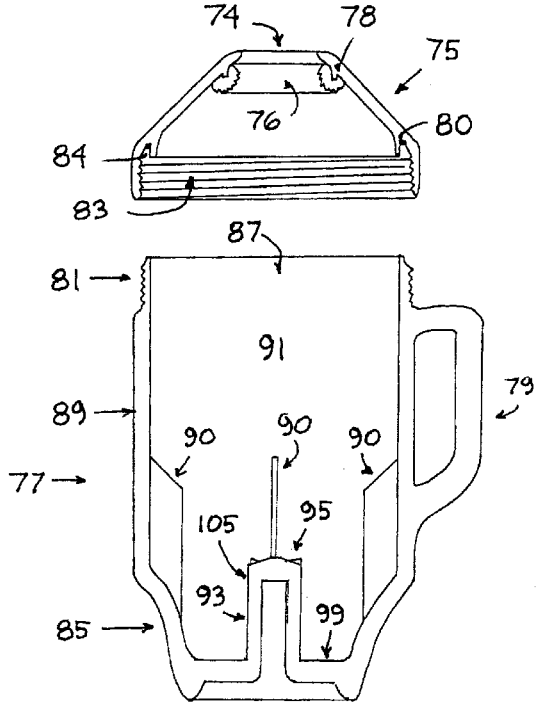
FIG. 11 is a section view showing a fixed pedestal.

Sealing ring 23 preferably has an engaging surface 25, which can have virtually any cross-sectional configuration that performs in the intended manner. For example, it can have a semi-circular or semi-oval cross-section, as shown in FIG. 11, and/or multiple blade or ribbed cross-section, as shown in FIG. 3, which can help promote water-tightness, even against unevenly shaped bottles. Sealing ring 23 can also be connected to cap 3 in any manner that provides a tight seal, including interlocking sections, adhesives, bonding, fusing, etc. Preferably, sealing ring 23 is formed with an extended flange 27 that fits above an upper edge 29 of cap 3 so that it can be snapped into opening 19 and held therein for ease of assembly. A raised projection 31 is preferably provided on cap 3 that mates with groove 33, which helps support sealing ring 23, and provides a pinching effect to ring 23 that helps to provide an effective seal.

Ring 23 is preferably made of resilient material, such as rubber, silicon, polypropylene, polyethylene, or like material, etc. The present invention contemplates that sealing ring 23 can be firm and/or thick enough, so that a degree of tolerance can be provided at the connection between sealing ring 23 and bottle 13. That is, even if bottle 13 is not made to exact dimensions, it is nevertheless contemplated that enough sealing pressure can be applied via ring 23, i.e., by virtue of its resiliency and/or thickness, against bottle 13 to prevent leaking. Although a preferred sealing ring 23 is shown, it can be seen that a variety of different types of sealing members are possible.

The connection between cap 3 and container 5 can be a conventional connection, such as those used to connect lids onto beverage containers, baby bottles, thermos bottles, etc. For example, cap 3 preferably has threads 35 along an internal diameter thereof for engaging threads 37 along an external diameter of container 5. An interference fit can be created between an upper rim 43 of container 5 and a groove 41 formed by an extension 39 extending downward above threads 35, wherein the connection between cap 3 and container 5 can be tightened and substantially sealed thereby. Groove 41 is preferably adapted to enable a seal to be made even if upper rim 43 is not fitted all the way into groove 41, to provide some tolerance as described above. Alternatively, a gasket, a pair of clamps, buckles, or similar device, can be provided to seal cap 3 onto container 5.

Various supports 4, 6 for supporting bottle 13 in relation to container 5 are contemplated. Supports 4, 6 preferably keep bottle 13 at a relatively fixed position inside container 5, so that when cap 3 and container 5 are connected together, bottle 13 can be held in substantial compression between sealing ring 23 and supports 4, 6, with ring 23 pressed tightly around bottle 13 to form a substantial water-tight seal. In this respect, cap 3 and container 5 are preferably adapted to hold a particular bottle 13, which requires the shape, size and location of supports 4, 6 to be adapted in conjunction with the shape, size and location of sealing ring 23, and the distance between them predetermined, for the particular bottle 13. With bottle 13 held in this manner, the threaded connection between cap 3 and container 5 can preferably be sealed at the same time that the engagement between sealing ring 23 and bottle 13 is sealed. That is, the connection and engagement are preferably sealed with cap 3 in the same position relative to container 5.

Figure 4:
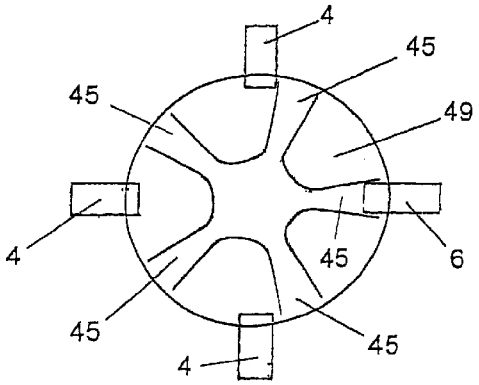
FIG. 4 shows the bottom of a typical PET bottle with five grooves.

At least three supports 4, 6 are preferably provided to create a support system to hold the lower end of bottle 13 in position inside container 5, wherein each support is preferably adapted to engage a particular surface of bottle 13. For example, in the embodiment of FIGS. 1–3, four supports are shown for demonstration purposes,—supports 4 for engaging the lower exterior surface 49 of bottle 13, and one slightly raised support 6 for engaging a groove 45 located on the underside of bottle 13. As seen in FIG. 4, the bottom 50 of a typical PET bottle 13 has multiple grooves 45, i.e., many have 5 grooves, to provide rigidity and support thereto. By forming at least one of the supports 6 to fit inside one of the grooves 45, the bottle 13 can be substantially prevented from rotating inside container 5. That is, the compression of bottle 13 between sealing ring 23 and supports 4, 6, enables the fit between the raised support 6 and one of the grooves 45 to be maintained, so that as long as cap 3 remains sealed on container 5, bottle 13 will not rotate. This enables the lid 47 of bottle 13 to be easily twisted open and closed without the bottle 13 rotating inside container 5. The embodiment shown has one raised support 6, but more of the supports 4, including all, can also be adapted to fit into the grooves 45 if desired.

In use, regular ice, such as chopped, cubed, crushed, etc., is preferably placed inside internal space 9 of container 5. An indicator line 48, as shown in FIG. 2, is preferably provided on the inside surface of container 5 to indicate how much ice should be placed therein. This helps the user know how much ice to use to maximize contact with bottle 13 while avoiding too much ice that could prevent bottle 13 from being inserted and cap 3 from being tightened.

Next, bottle 13 is pushed down into the ice, which causes some of the ice to be displaced, as shown in FIG. 9, and climb up the sidewalls of bottle 13. The curved and/or angled surface 51, in this respect, above the lower section 2, preferably causes ice to be displaced and distributed upward as the bottle 13 is being pushed downward. The location of surface 51 in relation to bottle 13 and supports 4, 6 preferably enables bottle 13 to be inserted without interference from ice within lower section 2. Water can be added to container 5 to make it easier for ice to be displaced and distributed around bottle 13 if desired.

Next, bottle 13 is preferably pushed down until the lower exterior surface 49 of bottle 13 is properly seated and rests on supports 4, 6. Cap 3 can then be placed over bottle 13 with neck 21 extended through opening 19, and then tightened onto container 5, which causes sealing ring 23 to be pressed against the shoulder of bottle 13, while at the same time, the connection between cap 3 and container 5 can be sealed. Ice and/or water within cavities 15, 17 can then be stored and sealed, substantially surrounding bottle 13, to help keep the beverage cool. This prevents water from leaking out, and enables the beverage to be poured and consumed directly from bottle 13, without having to remove bottle 13 from the ice.

Figure 6:
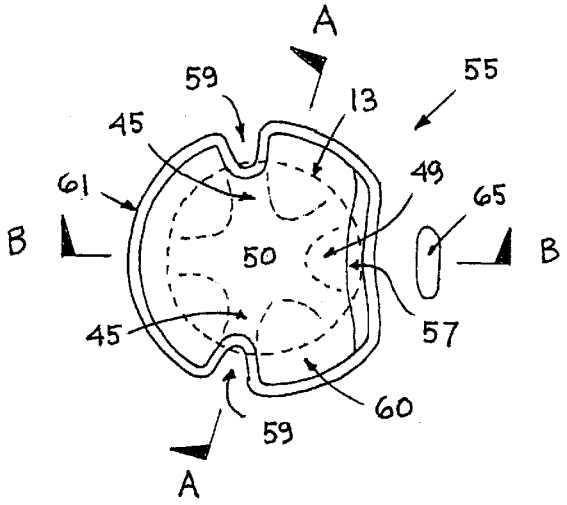
FIG. 6 is a horizontal section view of a blow-molded embodiment.
Figure 7:
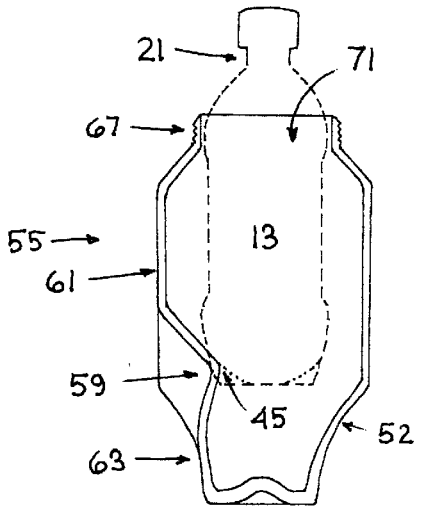
FIG. 7 shows section A—A of the blow-molded embodiment of FIG. 6.
Figure 8:
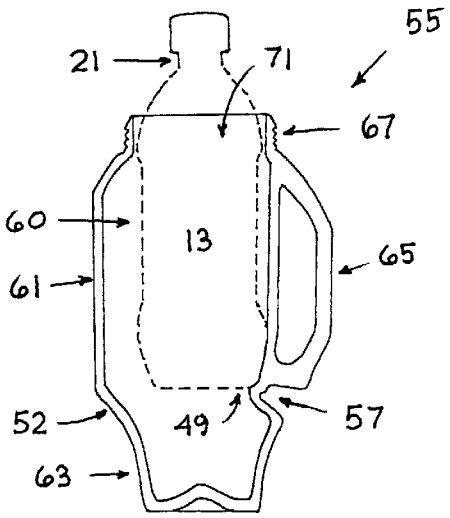
FIG. 8 shows section B—B of the blow-molded embodiment of FIG. 6.

FIGS. 6–8 show a preferred embodiment for a single serving bottle, such as a 20 ounce bottle, that can be manufactured at a relatively low cost. Container 55 is preferably molded, such as by blow-molding, from a single integral piece of moldable material. Container 55 is preferably generally sized and shaped like container 5, with a narrowed lower section 63, handle 65, threads 67, wall 61, cavity 60, opening 71, etc., wherein a similar cap 3 can be used, and a particular bottle 13 can be held in substantial compression therein. The supports 57, 59 on container 55, which are adapted to provide vertical and lateral support to bottle 13, however, are preferably indented directly into wall 61. That is, the entire container 55 is preferably formed from a single piece of material having substantially the same thickness, i.e., a thickness that can be formed using a blow-mold process, wherein the thickness of the material at supports 57, 59 is substantially predetermined to ensure that bottle 13 can be held in substantial compression between sealing ring 23 and supports 57, 59.

In this embodiment, three supports 57, 59 are preferably provided, wherein at least one support 59 is capable of fitting into one of the grooves 45 on bottle 13, to substantially prevent rotation of bottle 13. As shown in FIG. 6, this particular embodiment has two raised supports 59 that can fit into two of the grooves 45, and one support 57, as shown in FIGS. 6 and 8, adapted to engage one side of an exterior surface 49 of bottle 13. The three supports 57, 59 preferably help self-center bottle 13 inside container 55, i.e., as it is being pushed into the ice, wherein bottle 13 can rest on and be supported by the three supports 57, 59.

Figure 18:
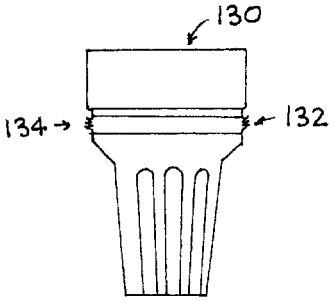
FIG. 18 shows an embodiment with external grip formations.
Figure 18:
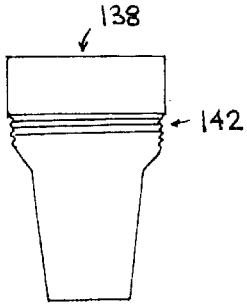
Figure 18:
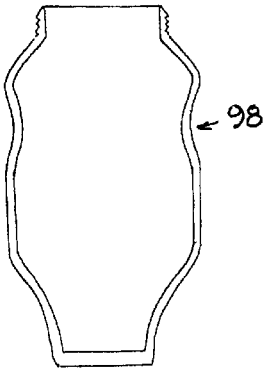

The two raised supports 59 on container 55, as shown in FIG. 6, are preferably positioned on opposing sides, such that they can fit into opposing grooves 45 on bottle 13. Support 57 is also preferably formed along a sidewall near handle 65, and, in this respect, is preferably positioned equidistant from raised supports 59, such that the three supports 57, 59 can form a triangulated support system, i.e., symmetrical about a vertical center plane B-B. This configuration allows a two-piece blow mold to be easily separated once container 55 has been formed. Like the previous embodiment, container 55 has a section 52 extended radially outward, as shown in FIG. 9, which allows ice to be easily displaced and distributed. To make container 55 even easier to mold, handle 65 can be replaced by indented grips 98 as shown in FIG. 18.

FIGS. 10–13 show an additional embodiment 73 having a cap 75 and container 77 capable of being secured and sealed together with bottle 83 inside. Like the previous embodiments, cap 75 is preferably adapted with an opening 74, through which neck 86 of bottle 83 can be extended. Inside container 77, a cavity 91 is also preferably formed in which ice and/or water can be stored, wherein cavity 91 is formed between wall 89 and bottle 83 when bottle 83 is inserted into container 77. While in one version, container 77 is specifically adapted and sized to fit a particular bottle 83, another version contemplates that various bottles of different sizes and shapes can be fitted inside container 77, i.e., by means of different central supports 93, as will be discussed. Although this embodiment can be adapted for any size bottle, it is particularly suited to larger bottles, such as 2 liter and 64 ounce PET bottles, where no need for a narrowed lower section exists, although the lower section 85 can be narrowed if desired.

Figure 12:
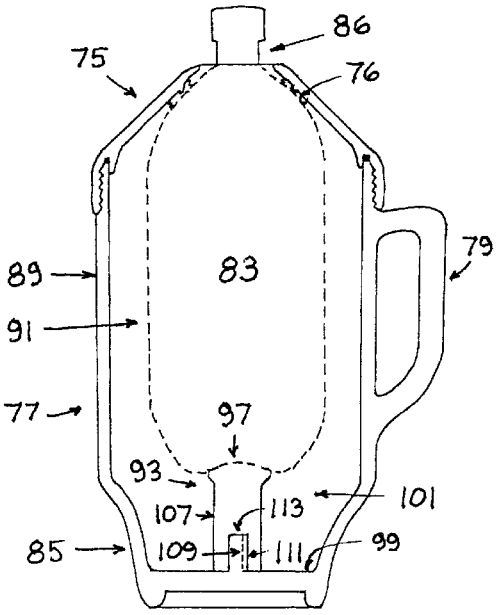
FIG. 12 is a section view showing a removable pedestal.

Two versions are shown in FIGS. 11–12. Both versions are provided with a central support 93 extending upward like a pedestal from the lower floor 99 of container 77, wherein the support 93 is adapted to provide vertical and lateral support to bottle 83. Bottle 83 is preferably held in substantial compression between sealing ring 76 on cap 75 and central support 93 inside container 77.

Figure 13A:
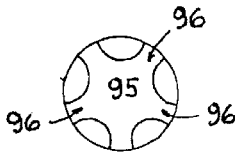
FIGS. 13*a* to 13*c* show views of the pedestal.
Figure 13B:
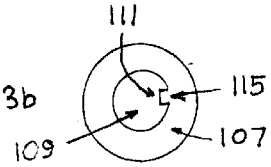
Figure 13C:
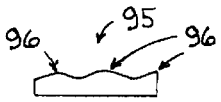

Support 93 preferably elevates bottle 83 above floor 99, wherein an additional cavity 101 can be formed under bottle 83, as shown in FIG. 12, such that additional ice and/or water can be stored therein, although this is not required. Lateral support can be provided by the engagement of central support 93 with bottle 83, as shown in FIG. 12. Most PET bottles have a concave indentation 97 in the bottom center, wherein a pattern with multiple grooves or other formations are provided to give rigidity and support thereto. The present invention contemplates that the upper surface 95 of central support 93, as shown in FIG. 13*a*, can be specifically configured with reciprocal grooves or formations 96, that are adapted to mate with, mesh or otherwise engage indentation 97, such that when bottle 83 is held in substantial compression, bottle 83 can be held in a relatively fixed position. Engagement of central support 93 with indentation 97 can substantially prevent rotation of bottle 83, i.e., by holding bottle 83 in substantial compression between ring 76 and support 93 with central support 93 pressed tightly against indentation 97. The upper surface 95 can be extended like a seat, as shown in FIGS. 13*a* and 13*c*, with contours 96.

FIG. 11 shows a fixed central support 105 extending from floor 99. This version is adapted to enable a particular bottle to be securely held inside, wherein the upper surface 95 preferably conforms to the shape of the particular indentation 97. A plurality of self-centering slats 90 or other formations (three or more) can be formed along wall 89 to guide bottle 83 onto central support 105. The support 105 can be formed as an indentation in floor 99, as shown, or a solid extension or attachment to floor 99, or any other manner.

FIG. 12 shows a removable central support 107, wherein a plurality of supports of varying sizes and shapes can be employed in connection with a single container 77. Each support 107 preferably has an upper surface 95 adapted for a particular bottle, i.e., depending on the shape of indentation 97. Each support 107 is also preferably a certain height depending on the height of the intended bottle. This way, a single container 77 can be used to fit a number of similar but differently sized and shaped bottles, simply by attaching and detaching supports 107 as needed.

Support 107 can be attached to floor 99 in a variety of ways. In each instance, the attachment is preferably adapted so that support 107 is prevented from rotating relative to floor 99. In one attachment, as shown in FIGS. 12 and 13*b*, a round stem 109 is extended from floor 99, which has a vertical slot 111. In such case, support 107 is provided with a reciprocal bore 113, with a slot-engaging extension 115. This way, support 107 can be attached and detached simply by sliding support 107 on and off stem 109. Alternatively, slot 111 can be in bore 113, and the extension 115 on stem 109. Moreover, stem 109 and bore 113 can be adapted with non-circular shapes, such as square, rectangular, triangular, etc., which can prevent rotation of support 107. The two pieces can also be reversed, i.e., bore 113 can be located on floor 99, and stem 109 can be extended from support 107.

Wall 89 can be made without self-centering slats 90 so that larger diameter bottles can be used. For example, instead of a 2 liter bottle 83, shown in FIG. 12, a wider and shorter 64 ounce PET bottle may be used. In such case, the slats 90 could interfere with the bottle, and should be eliminated or made smaller. Even without slats, however, support 107 is preferably adapted so that upper surface 95 provides a self-centering effect to bottle 83, wherein support 107 can support bottle 83 in a relatively fixed position. The top opening 87 on container 77 can also be made large enough, as shown, so that ice can be added to container 77 even after bottle 83 is inserted into container 77.

Like the previous embodiments, cap 75 preferably has threads 94 that engage threads 81 on container 77. A gasket 80 can be provided in interference groove 84, although any water-tight seal, such as a clamped connection with a gasket, can be employed. Sealing ring 76 in this embodiment is preferably more like an O-ring with blades or ridges extending longitudinally thereon capable of being sealed against various surfaces, which can be advantageous, for example, in versions where different bottles are used. Sealing ring 76 can be secured to cap 75 via a projection 78, as well as an adhesive, or other secure means, such as interlocking sections.

Figure 14:
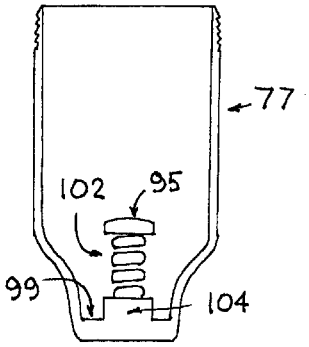
FIG. 14 shows a coil spring embodiment.

In an alternate embodiment, central support 93 can be a coil spring 102, as shown in FIG. 14, to accommodate bottles of different sizes. Spring 102 is preferably secured to floor 99 of container 77 via housing 104 in a manner that prevents rotation thereof, i.e., such as with a non-circular connection. Spring 102 is preferably substantially stiff enough to apply upward pressure to bottle 83 to maintain a water-tight seal against sealing ring 76, and to keep bottle 83 in a substantially fixed position, without being too stiff to where it would not compress under the pressure of cap 3, 75 being tightened on. The dimensions of spring 102 are preferably large enough, and the tension thereof preferably stiff enough, so that spring 102 will not twist with respect to itself, wherein by engagement of upper surface 95 with indentation 97 on bottle 83, bottle 83 can be substantially prevented from rotating, as described above. In this respect, upper surface 95 can be provided with a secure non-rotational attachment to spring 102 so that the entire pedestal prevents rotation. Spring 102 is preferably made of a rust-proof material such as aluminum or stainless steel.

Each main piece, including caps 3, 75 and containers 5, 55, 77, is preferably made from a moldable plastic, such as HDPE, polypropylene, etc., although any conventional material, such as stainless steel, glass, ceramic, etc., can also be used. While for insulation purposes containers 5, 55, 77 can be made of materials that conduct heat poorly, or with double wall construction, they can also simply be made of a relatively thick plastic. In this respect, the thickness preferably provides rigidity and a sufficient level of insulating properties thereto. Caps 3 and 75 and container 77 can be injection molded, although container 55 is preferably blow-molded. Blow-molding not only allows supports 57, 59 to be indented, but opening 71 to be narrow relative to wall 61. Container 5 can be made by any suitable method.

Other steps preferably involved in making caps 3, 75 and containers 5, 55 and 77 are measuring and/or scanning the bottle to obtain precise dimensions. This enables them to be adapted to a particular bottle, so that the bottle can be held in substantial compression leak-free. The present invention also contemplates that bottles can be custom made to fit the container, i.e., with surfaces that engage the sealing ring and supports, if desired. Textures, grips and/or indentations can also be provided on either piece for improved grip. The containers can have a side handle, as shown, although a strap or other type of handle, or indented grips 98, as shown in FIG. 18, can also be used. One or both pieces can be made of transparent material so that the contents can be seen from outside.

Figure 15:
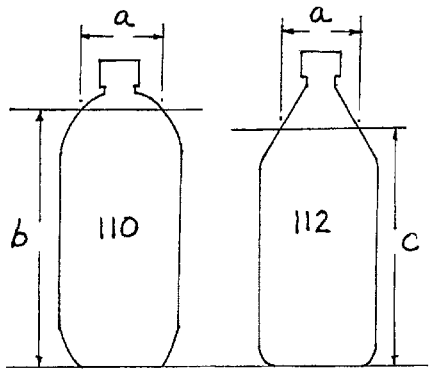
FIG. 15 shows two bottles having different sizes and shapes.

A unique aspect of the present invention is that the present cooling device can be made to accommodate a certain type of beverage bottle, whereas, other beverage bottles having different sizes and shapes could not be accommodated. In this respect, FIG. 15 shows two bottles 110, 112 having different shoulder configurations and heights. Bottle 110 has an effective shoulder height of b, based on a dimension a, which represents the effective diameter of sealing ring 23, 76. Bottle 112, however, has a shorter effective shoulder height of c, based on the same dimension a, of sealing ring 23, 76. Accordingly, using the same cap and container, with fixed supports on the bottom, such as supports 4, 6, 57, 59, and 105, the cooling device can be made so that it will accommodate one bottle 110 or 112, but not both. Of course, this may not be the case when removable supports 107 or adjustable springs 102 are used.

Figure 16A:
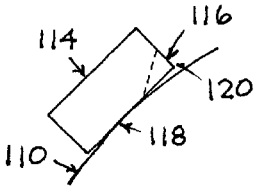
FIGS. 16*a* and 16*b* show cross-sections of an alternative sealing member.
Figure 17:
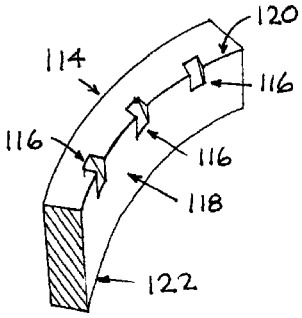
FIG. 17 shows a schematic of the sealing member of FIGS. 16*a* and 16*b;*
Figure 16B:
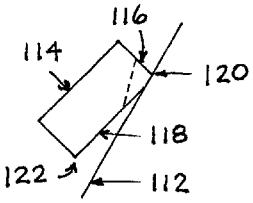

FIGS. 16*a*, 16*b*, 17 show an alternate embodiment of sealing ring 114 with openings 116 on one or more edges 120, 122 that effectively prevent bottles having different shoulder angles from being sealed properly in the same cooling device. With this embodiment, even if the effective shoulder height of each bottle is the same, if the shoulder angle is different enough, the bottle will not seal properly. For example, FIG. 16*a* shows sealing ring 114 sealed against bottle 110, wherein the shoulder angle of bottle 110 is adapted to engage flat surface 118. It can be seen that by pressing flat surface 118 against the shoulder of bottle 110, a proper seal can be provided. FIG. 16*b*, on the other hand, shows how the same sealing ring 114 cannot be sealed against the shoulder of bottle 112, wherein the shoulder angle is steeper and can cause edge 120 of ring 114, not flat surface 118, to engage bottle 112. With bottle 112 held in this manner, it can be seen that openings 116 will remain open and allow water to leak out despite sealing ring 114 being pressed against bottle 112. Ring 114 is preferably made of a relatively stiff resilient material, and openings 116 can be provided on one edge 120, as shown in FIG. 17, or the other 122 (not shown), or both edges 120, 122 (not shown), so that the cooling device will not function properly with bottles having steeper or shallower shoulder angles, as the case may be.

Other means of preventing other types of bottles to be used are contemplated, such as making the vertical and lateral supports so that they conform to only one type of groove or formation on the bottom of the bottle. This can be done, for example, where the bottom surface of the intended bottle has a unique configuration, or by custom making a bottle for a particular cooling device. Because only relatively minor changes would be required, new tooling may not be needed each time a modification is made.

For the above reasons, the present invention contemplates using a method where one beverage manufacturer can use the cooling device to increase sales and market share of its own beverage products at the expense of competitors. Because the cooling device can be made so that only one type of bottle can fit properly, by promoting the cooling device, i.e., getting people to try it and like it, a manufacturer can use the cooling device as a marketing tool to increase sales of its own beverage products. That is, consumers will have to buy bottled beverage products from that manufacturer if they want to use the cooling device to keep their beverages cold because only those bottles will work properly with the cooling device. Buying any other bottled product from any other manufacturer would make it so that the cooling device cannot be used.

Figure 19:
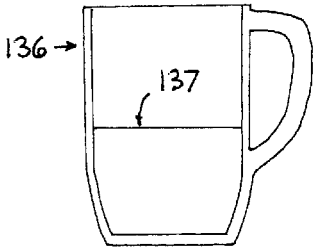

Additional disclosures that relate to the subject matter contained in U.S. application Ser. No. 09/983,107 are also provided in connection with FIGS. 19–21. FIG. 19 shows an inner container 130, which can be a cup-like member, which has a gasket, sleeve or sealing ring 132 extended around the exterior of sealing surface 134, rather than on the inside of outer container 136. This way, outer container 136 can be used as a standard mug, if desired, although it would not be interchangeable with other inner containers, such as aluminum cans. The connection between inner 130 and outer container 136 can also be accomplished by tightly fitting surfaces where friction alone can provide a water-tight seal. An air release groove, in such case, as previously discussed, is preferably provided. An indicator line 137 is preferably provided to show how much ice to put into outer container 136.

Figure 21:
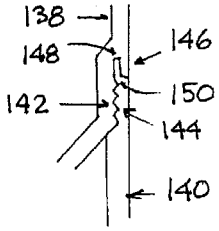
FIGS. 19–21 show additional embodiments of a device shown in U.S. patent application Ser. No. 09/983,107 identified above.
Figure 20:
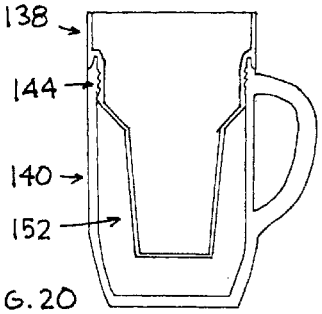

FIG. 20 shows an embodiment where the connection between inner container 138 and outer container 140 is made with threaded sections 142, 144. As shown in FIG. 21, an interference fit is preferably formed adjacent threaded sections 142, 144, wherein downward extension 146 on inner container 138 forms an interference groove 148 into which rim or upward extension 150 of outer container 140 can be fitted. This way, after ice is placed in outer container 140, inner container 138 can be screwed down into outer container 140, to seal the ice in cavity 152 with a water-tight fit. Other types of interference fits and gasket connections are also contemplated. U.S. Provisional Application Serial No. 60/246,493, filed Nov. 6, 2000, is also incorporated herein by reference.

The above discussion illustrates some of the preferred embodiments and features. It should be understood, nevertheless, that other embodiments and features, such as those not specifically disclosed herein, which may perform in the intended manner, are also within the scope of the present invention.

What is claimed is:

1. A cooling device for holding a beverage receptacle, comprising:

a container for holding ice particles therein, wherein said container is adapted to enable the beverage receptacle to be inserted at least partially therein, wherein a wall of said container is adapted such that when the beverage receptacle is placed in said cooling device, a space for storing the ice particles is formed between the beverage receptacle and said container;

a cap adapted to be substantially sealed onto said container, wherein said cap has an opening through which a neck of the beverage receptacle can be extended;

a sealing member on said cap adapted to be pressed against a shoulder portion of the beverage receptacle when the beverage receptacle is placed in said cooling device;

at least one support on the inside of said container for engaging the beverage receptacle, wherein at least one of said at least one support is adapted to engage a portion of the beverage receptacle in a manner that substantially prevents the beverage receptacle from rotating inside said cooling device; and wherein said cooling device is adapted such that when said cap is substantially sealed onto said container with the beverage receptacle inside, said sealing member is pressed and substantially sealed against the shoulder portion of the beverage receptacle, and places the beverage receptacle in substantial compression between said sealing member and said at least one support, and helps to substantially seal the space.

2. The device of claim 1, wherein said at least one support provides vertical support for the beverage receptacle, wherein an additional space is formed between the beverage receptacle and a floor of said container, and wherein at least a portion of the ice particles in said container can be distributed below the beverage receptacle in direct contact with the beverage receptacle.

3. The device of claim 2, wherein a bottom section of said container is narrowed in relation to a section of said wall above it, wherein said section above said bottom section is extended upward and radially outward, such that when the beverage receptacle is inserted into said container, at least a portion of the ice particles in said container is displaced upward substantially around the beverage receptacle.

4. The device of claim 3, wherein said at least one support comprises at least three support members extended inward from said wall of said container, at or near said section above said bottom section, wherein at least one of said at least three support members is adapted to fit into a groove or indentation located on a lower portion of the beverage receptacle, to substantially prevent the beverage receptacle from rotating inside said cooling device.

5. The device of claim 1, wherein said at least one support comprises at least three support members extended inward from said wall of said container for self-centering and supporting the beverage receptacle, wherein at least one of said at least three support members is adapted to fit into a groove or indentation located on a lower portion of the beverage receptacle, to substantially prevent the beverage receptacle from rotating inside said cooling device.

6. The device of claim 1, wherein said at least one support comprises a support member extending upward from a floor of said container, wherein said support member has an upper surface adapted to engage at least one groove or indentation located on a lower portion of the beverage receptacle, wherein the engagement of said support member with the beverage receptacle substantially prevents the beverage receptacle from rotating inside said cooling device.

7. The device of claim 6, wherein said support member is removable and non-rotatably attached to said floor, such that other support members of varying sizes and shapes can be non-rotatably attached to and detached from said floor.

8. The device of claim 6, wherein said support member comprises a coil spring adapted to be sufficiently stiff enough such that the engagement of said support member with the beverage receptacle can substantially prevent the beverage receptacle from rotating inside said container.

9. The device of claim 1, wherein said container has an indicator for indicating the amount of ice particles that should be placed in said container before inserting the beverage receptacle into said container.

10. The device of claim 1, wherein said cap has a threaded section and said container has a threaded section, wherein said threaded sections enable said cap and container to be substantially tightened together, wherein said cap has a gasket that can be substantially sealed onto said container at the same time that said sealing member is substantially sealed onto the beverage receptacle in said container.

11. The device of claim 1, wherein said sealing member is made from a resilient material and comprises at least one feature taken from the group consisting of:

a sealing portion that extends relatively downward and inward to engage and press against the shoulder portion of the beverage receptacle;

a plurality of ribbed or blade-like surfaces that can be pressed against the beverage receptacle;

a thickness sufficient to form a water-tight seal despite uneven surfaces and inexact dimensions of the beverage receptacle;

an inner lipped flange adapted to be extended through said cap's opening to enable said sealing member to be snapped into said cap, and at least one groove into which a projection on said cap can be inserted, wherein said projection helps support and provide a pinching effect to said sealing member.

12. The device of claim 1, wherein said sealing member has a first surface that can be substantially sealed against the shoulder portion of the beverage receptacle, and a second surface with openings therein that can prevent said sealing member from being sealed against a shoulder portion of a different beverage receptacle having a different size and/or shape placed in said container.

13. A cooling device for holding a beverage receptacle of a predetermined size and shape, comprising:

a container for holding ice particles therein, wherein said container is adapted to enable the beverage receptacle to be inserted at least partially therein, wherein a wall of said container is adapted such that when the beverage receptacle is placed in said cooling device, a first space is formed between the beverage receptacle and said container for storing the ice particles therein;

a cap adapted to be substantially sealed onto said container, wherein said cap has an opening through which a neck of the beverage receptacle can be extended;

a sealing portion on said cap adapted to be pressed against a shoulder potion of the beverage receptacle when the beverage receptacle is placed in said cooling device;

at least one support extended on the inside of said container adapted to engage and support the beverage receptacle in a manner that substantially prevents the beverage receptacle from rotating in said cooling device, wherein with the beverage receptacle in said cooling device, a second space is formed between a lower portion of the beverage receptacle and a floor of said container; and wherein said cooling device is adapted such that when said cap is substantially sealed onto said container, and said sealing member is pressed and substantially sealed against the shoulder portion of the beverage receptacle, the beverage receptacle is held in substantial compression between said sealing portion and said at least one support, and the first and second spaces are substantially sealed thereby.

14. The device of claim 13, wherein a bottom section of said container is narrowed in relation to a section above it, and wherein said at least one support comprises at least three support members extended inward from said wall of said container, at or near said section above said bottom section, wherein said section above said bottom section is extended radially outward in a manner that enables at least a portion of the ice particles in said container to be displaced upward when the beverage receptacle is pushed down into said container.

15. The device of claim 13, wherein said at least one support comprises at least three support members extended inward as indentations on said wall of said container, wherein at least one of said at least three support members is adapted to fit into at least one groove or indentation located on the lower portion of the beverage receptacle to prevent the beverage receptacle from rotating inside said cooling device.

16. A method of making a cooling device for holding a beverage receptacle of a predetermined size and shape, comprising:

determining the size and shape of the beverage receptacle by at least one method taken from the group consisting of: measuring the size and shape of the beverage receptacle; scanning the size and shape of the beverage receptacle; and adapting the beverage receptacle to have a predetermined size and shape;

forming an open-top container adapted to enable the beverage receptacle to be inserted at least partially into said container;

forming said container so that a space suitable for storing ice particles therein is formed between said container and the beverage receptacle when the beverage receptacle is inserted into said container;

forming a cap adapted to be substantially sealed onto said container, wherein said cap is formed with an opening through which a neck of the beverage receptacle can be extended;

forming a sealing member for said cap adapted to be pressed and substantially sealed against a shoulder portion of the beverage receptacle when the beverage receptacle is placed in said cooling device;

forming at least one support extended on the inside of said container for engaging and supporting the beverage receptacle, and for substantially preventing the beverage receptacle from rotating inside said container; and adapting said sealing member and said at least one support, and the distance between them, whereby when said cap is tightened and substantially sealed onto said container, the beverage receptacle is placed in substantial compression between said sealing member and said at least one support, the beverage receptacle is substantially prevented from rotating within said cooling device, and the pressure applied by said sealing member against the beverage receptacle helps to substantially seal said space.

17. The method of claim 16, wherein forming said container comprises making said container from an integral piece of moldable material, and forming said at least one support as an indentation on said container.

18. The method of claim 16, wherein the method comprises pre-selecting the beverage receptacle and adapting said cooling device based on the size and shape of the beverage receptacle, so that with the beverage receptacle in the cooling device, the space can be substantially sealed by tightening said cap onto said container, and so that other beverage receptacles having different sizes and/or shapes will not fit properly inside said cooling device, and/or will not allow a space between the other beverage receptacle and said container when the other beverage receptacle is placed in said container to be substantially sealed thereby.

19. The method of claim 16, comprising scanning the beverage receptacle, and forming said at least one support based on the size and shape of the beverage receptacle, such that at least one of said at least one support can fit into at least one groove or indentation located on a lower portion of the beverage receptacle, wherein when the beverage receptacle is held in substantial compression between said sealing member and said at least one support, the beverage receptacle is substantially prevented from rotating inside said container.

20. The product made by the method of claim 16.

21. A cooler for holding a beverage bottle of a predetermined size and shape, comprising:

a container for holding ice particles therein, wherein said container is adapted such that the bottle can be inserted at least partially therein, wherein said container is adapted such that with the bottle positioned in said container, a predetermined space is formed between the bottle and said container for storing the ice particles in direct contact with the bottle;

a cap adapted to be substantially sealed onto said container, wherein said cap has a threaded section located on a lower portion of said cap, and said container has a threaded section located on an upper portion of said container, to enable said cap to be substantially tightened and sealed onto said container;

wherein said cap has an opening through which a neck of the bottle can be extended, and at least one resilient sealing member adapted to be pressed and substantially sealed onto a shoulder portion of the bottle;

at least one supporting surface located on the inside of said container for providing vertical and lateral support for the bottle, and locating the bottle in a predetermined location inside said container, and adapted to substantially prevent the bottle from rotating inside said cooler;

wherein said cooler is adapted in relation to the bottle such that when the bottle is positioned in said container, said cap can be tightened and substantially sealed onto said container, at the same time that said sealing member is pressed and substantially sealed against the shoulder portion of the bottle; and wherein said sealing member is adapted to be pressed against the bottle to hold the bottle in substantial compression between said sealing member and said at least one supporting surface, wherein the pressure applied by said sealing member against the bottle helps to substantially seal said space.

22. The cooler of claim 21, wherein said sealing member is comprised of at least one feature taken from the group consisting of:

a sealing portion that extends relatively downward and inward to engage and press against the shoulder portion of the bottle;

a plurality of ribbed or blade-like surfaces that can be pressed against the bottle;

a thickness sufficient to form a water-tight seal despite uneven surfaces and inexact dimensions of the bottle;

an inner lipped flange adapted to be extended through said cap's opening to enable said sealing member to be snapped into said cap; and at least one groove into which a projection on said cap can be inserted, wherein said projection helps support and provide a pinching effect to said sealing member.

23. The cooler of claim 21, wherein said sealing member has a first section that can be sealed against the shoulder portion of the bottle, and a second section with openings that can prevent said sealing member from being sealed against a shoulder portion of a different bottle having a different size and/or shape placed in said container.

24. A cooler for holding a beverage bottle having a predetermined size and shape, comprising:

a container adapted to enable the bottle to be inserted at least partially therein, wherein said container is adapted such that when the bottle is placed in a predetermined location in said cooler, a predetermined space for storing ice particles in direct contact with the bottle is formed between the bottle and said container;

a cap adapted to be substantially sealed onto said container, wherein said cap has an opening through which a neck of the bottle can be extended, and wherein said cap has a sealing portion adapted to be pressed against a shoulder portion of the bottle when the bottle is placed in said container;

at least one support extended on the inside of said container for engaging and supporting the bottle in said predetermined location, wherein at least one of said at least one support is adapted to engage at least one groove or indentation located on the bottle to substantially prevent the bottle from rotating within said container; and wherein said cooler is adapted such that when the bottle is placed in said predetermined location, and said cap is substantially sealed onto said container, the bottle is held in a substantially fixed position between said sealing portion and said at least one support, and said space is substantially sealed thereby.

25. The cooler of claim 24, wherein said at least one support comprises at least three indented members extending inward from a wall of said container, wherein at least one of said indented members is adapted to fit into said at least one groove or indentation located on the bottle, and at least one other of said indented members is adapted to engage an exterior surface of a portion of the bottle, wherein a handle is provided on said container that extends above said one other of said indented members for carrying said cooler.

* * * * *